US007440719B2

(12) United States Patent
Kimura et al.

(10) Patent No.: US 7,440,719 B2
(45) Date of Patent: Oct. 21, 2008

(54) COLOR IMAGE FORMING APPARATUS HAVING PRE-TRANSFER DISCHARGER

(75) Inventors: Takenobu Kimura, Hachioji (JP); Satoshi Hamaya, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 421 days.

(21) Appl. No.: 11/359,151

(22) Filed: Feb. 22, 2006

(65) Prior Publication Data

US 2006/0239725 A1 Oct. 26, 2006

(30) Foreign Application Priority Data

Apr. 20, 2005 (JP) ..... 2005-122037
May 6, 2005 (JP) ..... 2005-135024

(51) Int. Cl.
*G03G 15/16* (2006.01)

(52) U.S. Cl. ..... 399/296

(58) Field of Classification Search ..... 399/127, 399/128, 296, 302, 308
See application file for complete search history.

(56) References Cited

U.S. PATENT DOCUMENTS 6,895,204 B2 * 5/2005 Shin ..... 399/296
7,209,692 B2 * 4/2007 Hamada et al. ..... 399/296
7,260,350 B2 * 8/2007 Hamada et al. ..... 399/296
7,298,997 B2 * 11/2007 Hamada et al. ..... 399/296
7,346,302 B2 * 3/2008 Sato et al. ..... 399/296
2007/0048030 A1 * 3/2007 Sato et al. ..... 399/296

FOREIGN PATENT DOCUMENTS

JP 10-274892 10/1998
JP 11-143255 5/1999
JP 2001356564 A * 12/2001
JP 2002023507 A * 1/2002

* cited by examiner

*Primary Examiner*—Robert Beatty
(74) *Attorney, Agent, or Firm*—Cantor Colburn LLP

(57) ABSTRACT

In the discharge section to correct the potential of toner image on the intermediate transfer body before the secondary image transfer and to obtain a good secondary transfer image, it is made that the opposite electrode is brought into contact with the back surface of the intermediate transfer body under the stable condition. Between the primary image transfer unit and the secondary image transfer unit along the intermediate transfer body, the scorotron discharger is arranged at the position where the intermediate transfer belt is supported plane-likely, and on the rear side of the intermediate transfer body opposing to the grid of the discharger, the opposite electrode composed of the electric conductive brush is arranged, the electric conductive brush is brought into contact with the intermediate transfer body, and electrically grounded, and at least one of the plurality of support members has a configuration for adding more tension in the vicinity of the center of the intermediate transfer belt than in the vicinity of the both ends.

14 Claims, 7 Drawing Sheets

COLOR IMAGE FORMING APPARATUS HAVING PRE-TRANSFER DISCHARGER

This application is based on Japanese Patent Application No. 2005-122037 filed on Apr. 20, 2005, and 2005-135024 filed on May 6, 2005, in Japanese Patent Office, the entire content of which is hereby incorporated by reference.

TECHNICAL FIELD

The present invention relates to a color image forming apparatus using an electro-photographic method.

BACKGROUND

In the color image forming apparatus of the electro-photographic method using an intermediate transfer body, an apparatus in which a toner image formed on an image carrier which is a photo conductor is transferred on the intermediate transfer body, and the toner image on the intermediate transfer body is transferred onto a transfer material (called also recording sheet, or sheet), is well known. In such a color image forming apparatus, after the toner image successively formed on the image carrier and charged into a predetermined polarity is transferred on the intermediate transfer body by being superimposed by a primary image transfer unit by using an electrostatic force, the toner image on the intermediate transfer body is collectively transferred onto the transfer material by using an electrostatic force by a secondary image transfer unit.

Because a charging amount per one particle of a toner is almost uniform, the electrical potential on the intermediate transfer body is determined by toner adhesion amounts in a predetermined area, and in the color image forming apparatus, the charge potential of a part the toner image on the intermediate transfer body where a plurality of colors of toners are superimposed, is higher than a charge potential of a part where only one color toner is adhered.

When a fluctuation of the potential on the intermediate transfer body after the primary image transfer is large, various image failures are easily generated. In Patent Documents 1, 2, it is proposed that, uniform secondary image transfer can be conducted, by uniforming the charge amount of the toner on the intermediate transfer body by charging the toner image on the intermediate transfer body before the secondary image transfer by a corona discharge of AC or DC.

[Patent Document 1] Unexamined Japanese Patent Application Publication No. 10-274892

[Patent Document 2] Unexamined Japanese Patent Application Publication No. 11-143255

In such a proposition, the charged amount of the toner on the intermediate transfer body is uniformed to a large amount. However, when the toner layer potential is high, the density fluctuation is easily generated by the transfer charge shortage, and when the transfer charge is made large, the disturbance of the image by discharging is easily generated. Accordingly, the present inventors are studying on uniforming the charge amount by discharging the toner image on the intermediate transfer body before the secondary image transfer.

Toner layers on the intermediate transfer body have various cases from 1-layer to multi-layers, and in order to not too-much discharge the toner and to charge the appropriate charge, the present inventors are studying on the uniform charging by the scorotron discharge.

The scorotron discharge is conducted in such a manner that: a grid to which voltage is applied is arranged with a gap of about 1 mm against the intermediate transfer body(belt), and from the back of the body, the discharge by a discharge electrode using wire is conducted. Further, on the back surface of the intermediate transfer belt on which grids are arranged, the opposite electrodes are arranged.

Eelectrically grounded rollers which wind the intermediate transfer belt are excellent as the opposite electrode in a point that the rollers reduce a load of the intermediate transfer belt, however, when the linear speed of the intermediate transfer belt is large in the high speed machine, it is necessary that the grid width opposite to the intermediate transfer belt need to be large in order to obtain a sufficient discharge effect. However, when a place having a curvature such as a roller is made an opposite electrode, there is a limit in increasing the width of the electrode under the condition that a gap between the intermediate transfer belt and the grid is kept within a certain range, and there is a problem that the toner charge can not be controlled.

Accordingly, a method that the electrically grounded electrode is arranged being opposed to the plane part of the rotating intermediate transfer belt, is applied.

When, an opposite electrode is arranged opposite to the part of the plane of the rotating intermediate transfer belt, the opposite electrode is fixed and the opposite electrode slides on the belt surface from the back surface of the intermediate transfer body. For the opposite electrode, an electric conductive brush or an electric conductive sponge is used, and for the purpose to make the conductivity through the opposite electrode, in order to make the contact state good, it is necessary that the belt back surface is pressed by the opposite electrode with a certain degree of loading. The intermediate transfer belt is rotated under the condition of being tensioned, and the width of the intermediate transfer belt need to be 300 mm or more to accommodate to sheets of A4 size. In that case, the difference of the stress is generated to the moving direction between the central part and the end parts, as the result, when pressed by the opposite electrode, the central part of the belt is pushed, and the phenomenon that the belt is raised to the grid side, is generated. The gap between the intermediate transfer belt surface and the grid varies depending on the position of the belt width direction, and the discharge efficiency varies between the central part of the belt and the end part, and the discharge control for uniforming the charge on the toner image cannot be conducted.

SUMMARY

An object of the present invention is to provide an image forming apparatus which employs a scorotron electrode to discharge the toner image of the intermediate transfer belt, and which has a high discharge effect by making the opposite electrode contact uniformly with the intermediate transfer belt on a plane part of the intermediate transfer belt to make the discharge width broad.

The present invention is structured as follows.

(1) A color image forming apparatus, comprising: an image carrier; an image forming unit which forms a toner image on the image carrier; a plurality of support members; an intermediate transfer belt which is extended and given a tension by the plurality of support members; a primary image transfer unit which transfers the toner image on the image carrier onto the intermediate transfer belt; a secondary image transfer unit which transfers a toner image on the intermediate transfer belt onto a transfer material; a scorotron discharger which is arranged on the upstream of the second image transfer unit, includes a discharge electrode and a grid electrode and discharges a charge on the toner image on the intermediate transfer belt; and an elastic body electrode which is arranged to be opposite to the scorotron discharger and to contact the back of the part of the intermediate transfer belt where the intermediate transfer belt is supported in a planar state; wherein at least one of the plurality of support members is a supporting member having the configuration which has a configuration for adding more tension in the vicinity of the center of the intermediate transfer belt than in the vicinity of the both ends.

(2) A color image forming apparatus, comprising: an image carrier; an image forming unit which forms a toner image on the image carrier; a plurality of support members; an intermediate transfer belt which is extended by the plurality of support members; a primary image transfer unit which transfers the toner image on the image carrier onto the intermediate transfer belt; a secondary image transfer unit which transfers the toner image on the intermediate transfer belt onto a transfer material; a discharge section which is arranged on the upstream of the second transfer unit and discharges a charge on the toner image on the intermediate transfer belt; and an elastic body electrode which is arranged to be opposite to the discharge section and to contact the back of the intermediate transfer belt; wherein the color image forming apparatus comprises a pressing section which presses the elastic body electrode to uniformly contact the intermediate transfer belt.

DETAILED DESCRIPTION OF THE PREFERRED EMBODIMENT

An embodiment of the present invention will be described below, however, the present invention is not limited to the embodiment described below.

Figure 1:
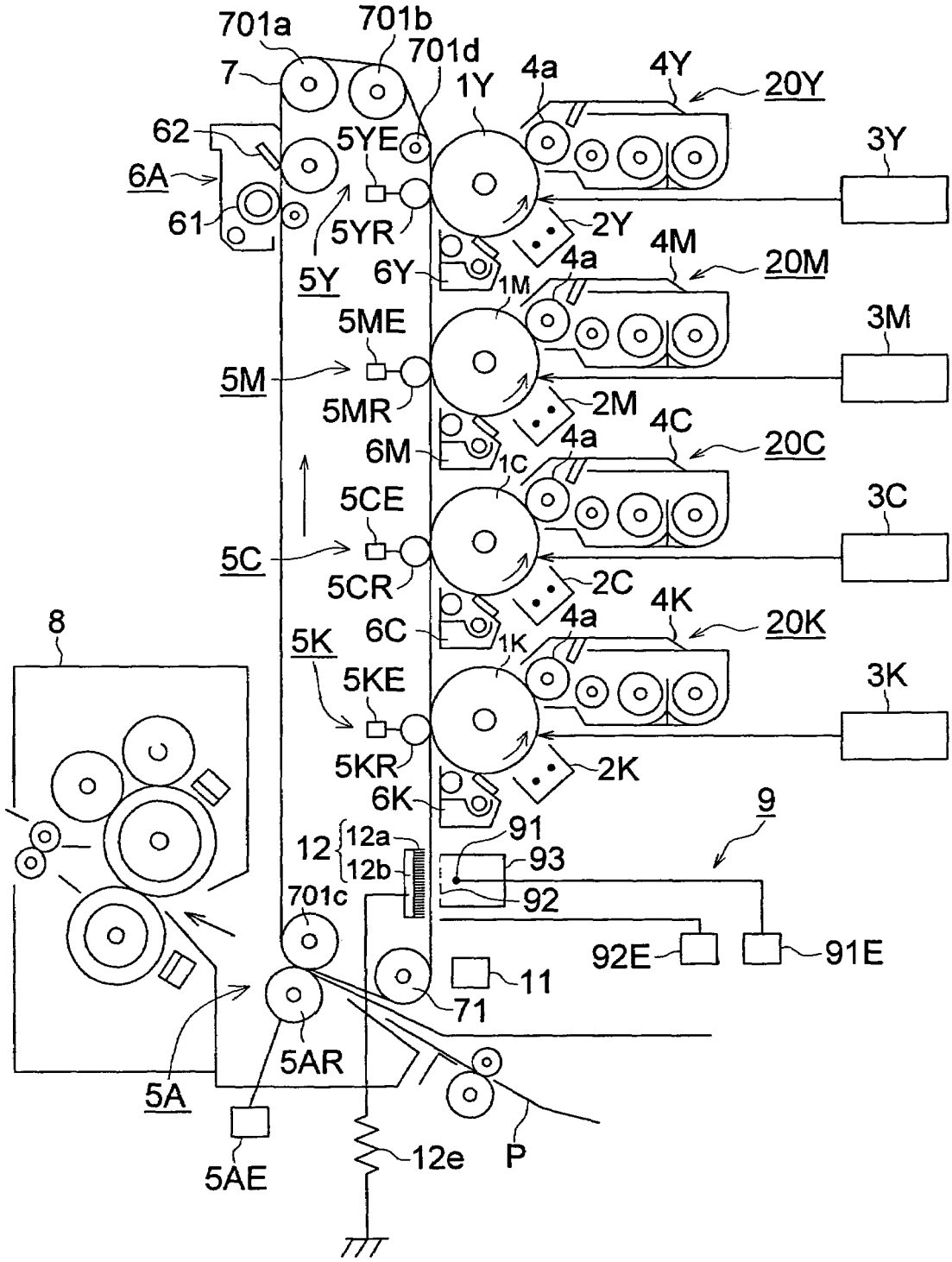
FIG. 1 is a sectional view showing an outline structure of an image forming apparatus of the first example of the first embodiment of the present invention.

FIG. 1 is a sectional view showing an outline structure of a color image forming apparatus according to the present embodiment.

This color image forming apparatus is called as a tandem type color image forming apparatus, and has a plurality,of image forming units 20Y, 20M, 20C, 20K, intermediate transfer unit, sheet feed conveying device, and a fixing device 8.

The image forming unit 20Y forming a yellow image has a charging device 2Y arranged around the photo conductor 1Y as an image carrier, an exposing device 3Y, a developing device 4Y, a primary image transfer unit 5Y, and a cleaning unit 6Y. The image forming unit 20M forming a magenta image has a charging device 2M arranged around the photo conductor 1M as an image carrier, an exposing device 3M, a developing device 4M, a primary image transfer unit 5M, and a cleaning unit 6M. The image forming unit 20C forming a cyan image has a charging device 2C arranged around the photo conductor 1C as an image carrier, an exposing device 3C, a developing device 4C, a primary image transfer unit 5C, and a cleaning unit 6C. The image forming unit 20K forming a black image has a charging device 2K arranged around the photo conductor 1K as an image carrier, an exposing device 3K, a developing device 4K, a primary image transfer unit 5K, and a cleaning unit 6K.

A belt-like intermediate transfer body which is semi-conductive, is wound by a plurality of rollers 701*a*, 701*b*, 701*c*, 701*d*, 71, and supported circulation-movably. In the present embodiment, the intermediate transfer body 7 is supported to be planar between a primary image transfer unit 5K and a roller 71.

By a image forming section composed of a charging device 2Y, exposing device 3Y, and developing device 4Y, the charging, exposing and developing are conducted on the photo conductor 1Y, and a yellow toner image is formed on the photo conductor 1Y. In the same manner, by an image forming section composed of the charging device 2M, exposing device 3M and developing device 4M, a magenta toner image is formed on the photo conductor 1M, and by the image forming section composed of the charging device 2C, exposing device 3C and developing device 4C, a cyan toner image is formed on the photo conductor 1C, and by the image forming section composed of the charging device 2K, exposing device 3K and developing device 4K, a black toner image is formed on the photo conductor 1K. These monochrome toner images are transferred onto the intermediate transfer body 7 by the transfer rollers 5YR, 5MR, 5CR, 5KR, and superimposed, and a multi-color toner image is formed.

As the photo conductor 1Y, 1M, 1C, 1K, a well-known photo conductor such as the OPC photo conductor, or a-Si photo conductor is used, however, the OPC photo conductor is preferable, particularly, an OPC photo conductor having the negative electrostatic property is preferable, and in the present embodiment, the OPC photo conductor having the negative electrostatic property is used.

As a charging device 2, the corona discharging device such as scorotron, corotron is used, and the scorotron discharger is preferably used.

As an exposing device, a light emitting element such as a laser, LED array which emits light according to the image data is used.

As developing devices 4Y, 4M, 4C, 4K, a two-component developing device which uses two-component developer whose main component are a carrier and toner, or a two-component developing device which uses one-component developer which includes the toner as a main component without a carrier, however, the two-component developing device is preferable. Further, the developing device which is used in the normal development, or which conducts the reversal development can be used as the developing device, however, the reversal development, which conducts development by the toner charged in the same polarity as the charge of the photo conductor with a developing bias of the same polarity as the charge of the photo conductors 1Y, 1M, 1C, 1K applied on a developing sleeve 4*a*, is preferable, and in the present embodiment, the development is conducted by the reversal development using the negatively charged toner.

From the view point that the high image quality is maintained, and the generation of fogging is prevented, a toner whose volume average particle diameter is 3-6 μm, is preferable.

The volume average particle diameter is the average particle diameter based on the volume, and is a value measured by (Coulter counter TA-II) provided with a wet dispersion machine, or (Coulter Multisizer) (both are made by Coulter co.).

The high quality image having the high resolution can be formed by such a toner.

Further, in the present invention, a spherical toner is preferable, and as the conglobation degree, more than 0.94 and less than 0.98 is preferable in which it does not receive strong stresses, fogging or toner spattering is hardly generated, further, cleaning performance can be maintained high.

The conglobation degree is obtained by the following equation.

The conglobation degree=(peripheral length of a circle of the same area as the particle projection image)/(peripheral length of the particle projection image)

The conglobation degree can be calculated by obtaining the arithmetic average value of the circularity degrees which is obtained by the analysis of the photographic image, using the image analyzer (SCANNING IMAGE ANALYSER) (made by Nippon Denshi Co.), of the photographs of 500 resin particles taken by the scanning type electro micro scope or the laser micro scope being enlarged by 500 times. Further, as a simple measuring method, it can be measured by (FPIA-1000) (made by Toa medical electronics co.).

For a toner of a small particle diameter and of high conglobation degree as described above, it is preferable to use a polymerization toner.

The polymerization toner means the toner which is obtained by generating the binder resin for toner and by obtaining the toner shape thorough the polymerization of raw material monomer of the binder resin or pre-polymer and thorough the chemical processing after that. More specifically, it means a toner obtained via the polymerization reaction such as the suspension polymerization or emulsion polymerization, and fusing process of mutual particles conducted at need after that. With the polymerization toner, because the toner is manufactured by polymerization after the raw material monomer or pre-polymer is uniformly dispersed in the watery solvent, the toner with uniform particle diameter distribution and shape is obtained.

Specifically, the toner can be produced by the suspension polymerization method, or by a method that the fine polymerization particle is produced by emulsion-polymerizing the monomer in the liquid of the watery medium with the emulsification agent added and then associating by adding organic solvent, flocculation agent and so on. There are a method that the toner is associated and fabricated by blending dispersion liquids of a mold release agent, a coloring agent and the like necessary for the construction of a toner when association and a method emulsion-polymerizing after dispersing the mold release agent, coloring agent and the like in the monomer. Herein, the association means that a plurality of the resin particles and the coloring agent particles are fused into one body.

Numeral 5A is a secondary image transfer unit, and is composed of a transfer roller 5AR formed of an electric conductive rubber roller, and a power supply 5AE.

Numeral 6A is an intermediate transfer body cleaning unit for cleaning the intermediate transfer body 7, and numeral 8 is a transfer device for transferring the toner image onto a transfer material P.

The intermediate transfer body 7 is a single layer or multi-layered belt, whose width is 320 mm formed of polyamide or polyimide, and whose volume resistivity is $10^7$-$10^{12}$ Ωcm (in the present embodiment, $10^9$ Ωcm), and whose surface resistance is $10^{11}$ Ω, is used.

After the secondary image transfer is conducted onto the transfer material P by the transfer roller 5A, the intermediate transfer body 7 passes the intermediate transfer body cleaning unit 6A, and is cleaned.

In the present embodiment, the scorotron discharger 9 which is a discharging section before secondary image transfer is arranged along the intermediate transfer body 7 at a position between the primary image transfer unit 5K and the secondary image transfer unit 5A where the intermediate transfer body is supported to be planar. The detail of the scorotron discharger 9 will be described by using FIG. 2.

Figure 2:
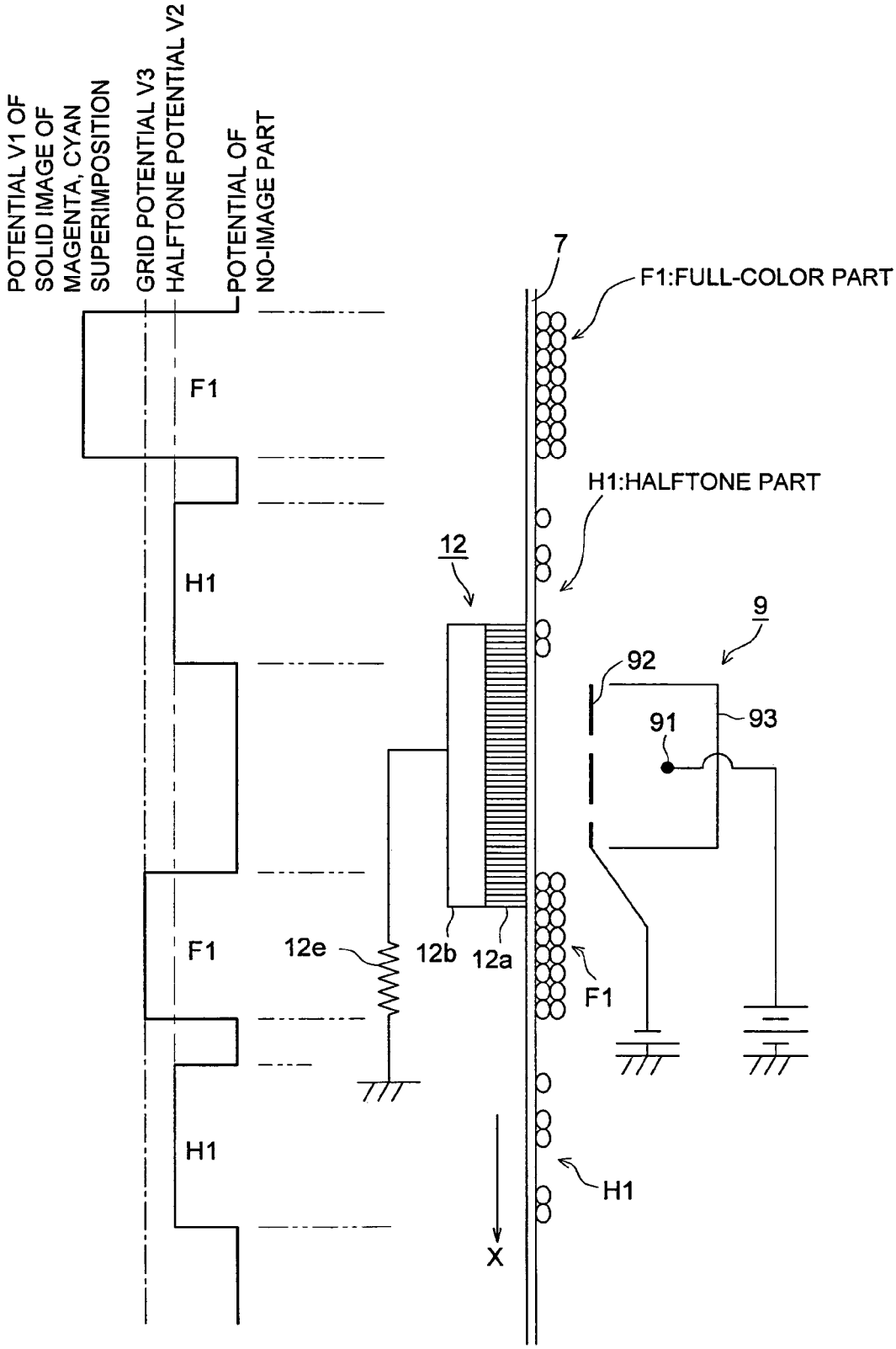
FIG. 2 is a sectional view showing outline structures of a scorotron discharger according to the first embodiment of the present invention and an electric-conductive brush, and a typical view showing the change of the toner layer electric potential before and after the passage of the scorotron discharger.

FIG. 2 is a sectional view showing the outline structure of the scorotron discharger 9 in FIG. 1. The scorotron discharger 9 is composed of a discharging electrode 91, grid 92, side plate 93, and the grid 92 is arranged opposite to the belt surface of the intermediate transfer body 7 with a gap of 1 mm in the present embodiment, and the side plate 93 is connected to the same potential as the grid 92 in by a not-shown circuit.

As the grid 92, a wire grid or a plate-like grid in which the pattern is formed on the sheet metal by etching, can be used, however, in the present embodiment, a plate-like grid on which gold-plating is conducted is used. Further, the grid 92 has the length of 30 mm in the present embodiment in the movement direction (arrowed X-direction) of the intermediate transfer body 7.

As the discharging electrode 91, wire rod such as tungsten, stainless steel and gold whose diameter is 20-150 μm can be used, however, particularly, it is preferable that the surface is formed of gold. The wire rod itself is produced by gold, or the surface of the base material such as stainless steel or tungsten may be coated by gold. The thickness of gold coating film is preferable 1 μm-5 μm on an average from the view point of the removal efficiency of the discharge products such as ozone, or production cost, and the discharge efficiency.

Further, as the discharging electrode 91, other than the electrode using the wire rod, needle-like electrode may also be allowable.

On the rear side of the intermediate transfer body opposed to the scorotron discharger 9, the opposite electrode 12 composed of the electric conductive brush 12*a* and the retaining member 12*b* for retaining the electric conductive brush 12*a* is arranged, and the electric conductive brush 12*a* is brought into contact with the rear side of the intermediate transfer body, and the opposite electrode 12 is, electrically grounded through the resistance 12*e*.

The electric conductive brush 12*a* is composed of the electric conductive resin such as acrylic resin, nylon and polyester, and it is preferably composed of the line diameter which is from 0.111 tex. to 0.778 tex. in the measuring unit by the number method proposed by ISO (in the present embodiment, 0.33 tex.), the brush density which is from 12000 lines/$cm^2$ to 77000 lines/$cm^2$ (in the present embodiment, 31000 lines/

$cm^2$), raw yarn resistance value which is $10^0$ to $10^5$ Ωcm (in the present embodiment, $10^2$ Ωcm).

Hereupon, as the opposite electrode 12, instead of the electric conductive brush, also by using the electric conductive sponge, the same effect can be obtained. As the electric conductive sponge, urethane rubber such as ether series polyurethane into which carbon black is mixed, ethylene propylene rubber, hydrine rubber, silicon rubber can be used, and the sponge whose volume resistivity is $10^3$-$10^9$ Ωcm, and the thickness is, for example, 5 mm, is used.

In the present embodiment, the structure, where DC voltage of DC bias voltage 0-+5 kV by which the discharging is conducted with the opposite polarity to the toner can be applied to the discharging electrode 91, and the voltage of 0--300V can be applied to the grid 92, is applied.

In the present embodiment, the voltage of +4 kV is impressed on the discharging electrode 91 of the scorotron discharger 9, and the voltage of −50 V is impressed on the grid 92.

The action of the scorotron discharger 9 will be described by using FIG. 2.

FIG. 2 is a typical view showing the change of toner layer potential on the intermediate transfer body 7 before and after the passage of the scorotron discharger 9 on which the voltage is impressed. Hereupon, the same signs are affixed to the same structure as shown in FIG. 1, and the explanation will be omitted.

The potential V1 of the full-color part F1 in which the toner addition amount potential is high, is lowered when the part F1 passes the discharger 9, however, the potential V2 of the half tone part H1 in which the toner addition amount potential is low, is maintained as it is.

In the present embodiment, in a plurality of rollers stretching the intermediate transfer body 7, at least one roller is made a convex roller, and as particularly preferable arrangement position of convex roller, it is listed that arrangement position is between the most downstream side's primary image transfer unit 5K and the scorotron discharger 9, or between the scorotron discharger 9 and the secondary image transfer unit 5A. "Convex" means here a shape that has a bigger diameter at the center than the both ends.

In FIG. 1, the first example is shown, between the opposite electrode 12 and the secondary image transfer unit 5A, the roller 71 stretching the intermediate transfer body 7 is made a convex roller (force adding member). The convex roller is a roller using aluminum material, and has a convex shape at whose central part the diameter is 26 mm, and at whose both end parts the diameter is 24 mm. Then, the penetration amount of the electric conductive brush 12*a* of the opposite electrode 12 to the intermediate transfer body is 1 mm, and the brush slides pressing the belt from the back surface of the intermediate transfer body 7.

Figure 3:
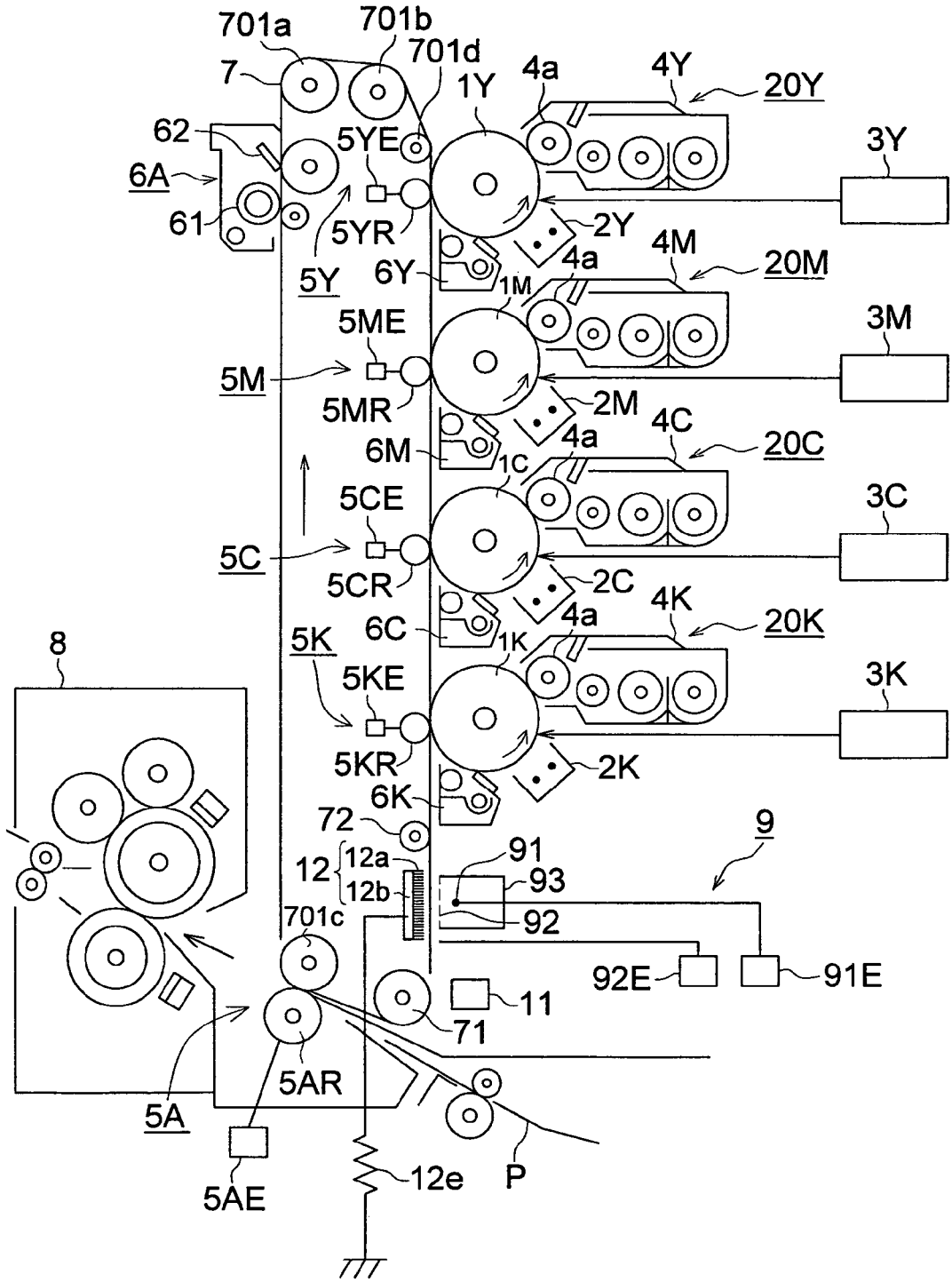
FIG. 3 is a sectional view showing an outline structure of the image forming apparatus of the second example of the first embodiment of the present invention.

FIG. 3 is the second example, and the same sign is affixed to the element of the same function as in FIG. 1, and the description will be neglected in FIG. 3. In the second example, the convex roller 72 is newly provided between the most downstream side of the primary image transfer unit 5K and the opposite electrode 12, and it is structured such that, while the convex roller 72 presses the back surface of the rotating intermediate transfer body 7, it is moved and rotated. The convex roller 72 is a roller using aluminum material, and has the convex shape in which at the central part, the diameter is 26 mm, and at both end parts, the diameter is 24 mm. Then, the electric conductive brush 12*a* of the opposite electrode 12 has a penetration amount of 1 mm, and slides pressing from the back surface of the intermediate transfer body 7.

In order to confirm the effects of examples 1 and 2, the condition setting of the following comparative examples 1 and 2 are conducted.

In the comparative example 1, the roller 71 of the example 1 described by using FIG. 1 is made a parallel roller instead of a convex roller, and the other parts are set to the same as in example 1. That is, the penatration amount of the electric conductive brush 12*a* of the opposite electrode 12 is 1 mm, and the brush has the structure in which the brush presses from the back surface of the intermediate transfer body 7 and slides on it.

In the comparative example 2, the roller 71 of the example 1 described by using FIG. 1 is made a parallel roller instead of a convex roller, and the penatration amount of the electric conductive brush 12*a* of the opposite electrode 12 is 0.5 mm, and the brush has the structure in which the brush presses from the back surface of the intermediate transfer body 7 by the weaker pressing force than the comparative example 1 and slides on it.

The following 2 measurements are conducted, on examples 1 and 2, and comparative examples 1 and 2, as a method for confirming the effect of the present embodiment.

The first measurement is conducted in such a manner that, by using the laser displacement gauge, the gap between the grid 92 and the back surface of the intermediate transfer body 7 is measured for 3 places of the hither side, central part and the farther side, for the width direction of the belt. Table 1 is a measurement result.

TABLE 1

| | Hither side position | Central part position | Farther side position | Estimation |
|---|---|---|---|---|
| Example 1 | 1.0 | 1.0 | 1.0 | good |
| Example 2 | 1.0 | 1.0 | 1.0 | good |
| Comparative example 1 | 1.0 | 0.6 | 1.0 | no good |
| Comparative example 2 | 1.0 | 1.0 | 1.0 | good |

(unit: mm)

Prior to the above measurement, when the correspondence to the gap between the grid 92 and the belt back surface of the intermediate transfer body 7 and the quality of the image was tried to be confirmed, it is recognized that if the gap gets 0.7 mm or less, although the gap had been once set to 1 mm, an image failure due to the toner scattering was generated for a position of the monochrome halftone, image.

The second measurement is conducted in such a manner that, in order to confirm whether the discharge effect is obtained by using the electric conductive brush 12*a*, for the solid image in which magenta and cyan images are superimposed, the potential after discharge by the scorotron discharger 9 is measured for 3 positions of hither side, central part and farther side in the belt width direction by the electrometer 11. Table 2 shows the measurement result and the estimation.

TABLE 2

| | Hither side position | Central part position | Farther side position | Estimation |
|---|---|---|---|---|
| Example 1 | −135 | −130 | −130 | good |
| Example 2 | −135 | −130 | −130 | good |

TABLE 2-continued

| | Hither side position | Central part position | Farther side position | Estimation |
|---|---|---|---|---|
| Comparative example 1 | −135 | −120 | −130 | good |
| Comparative example 2 | −150 | −150 | −155 | no good |

(unit: V)

Prior to the above estimation, when the correspondence of the potential after the discharge and the quality of the image was tried to be confirmed, it was recognized that the potential after the discharge was less than −140 V (absolute value), a good image is obtained. In the above-described measurement, when the discharge performance is insufficient, at the time of output of the rear surface image under the low temperature low humidity circumstance, an uneven transfer is generated.

From the above measurement result, with the present embodiment, the position displacement of the intermediate transfer body 7 by the pressing of the opposite electrode 12 is prevented, the effective discharge is conducted, and a good image without the toner scattering of the halftone image and the uneven image at the time of the rear surface transfer of the 2-color solid superimposed image is obtained.

Therefore, with the above mentioned embodiment, the tension at each part in the width direction of the intermediate transfer belt is adequately adjusted, even if the opposite electrode of the elastic body presses the intermediate transfer belt from the back surface of the belt, the planarity of the belt is maintained, and the gap between the belt surface and the grid is also maintained to a predetermined gap, the good discharge effect is obtained, and the good transfer image is obtained.

And the convex roller, provided between the primary image transfer unit on the lowest stream side and the elastic body electrode or between the elastic body electrode and the secondary image transfer unit, enables the tension in the belt of the intermediate transfer belt to be adjusted precisely, and the planarity within the discharge range is maintained really excellently.

Further, using the electric-conductive brush material or a sponge material as the elastic body electrode, even when the weak pressing force is applied, a good state of the conduction to the intermediate transfer belt is maintained.

Figure 4:
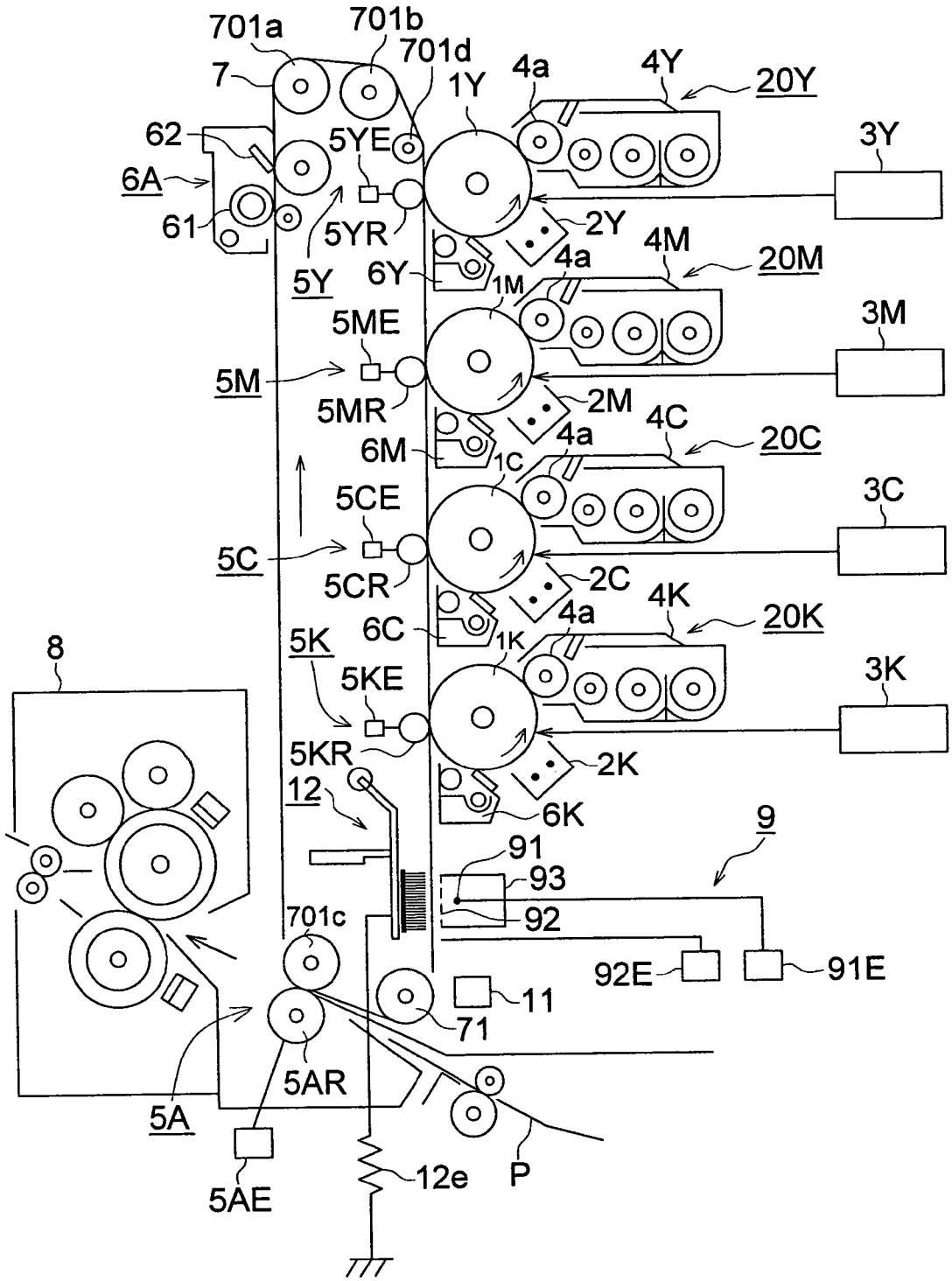
FIG. 4 is a sectional view showing an outline structure of the image forming apparatus of the second embodiment of the present invention.

FIG. 4 is a sectional view showing the outline structure of the color image forming apparatus according to the second embodiment of the present invention. In FIG. 4, the same sign is affixed to the element of the same function as in FIG. 1, and the description is omitted.

Figure 5:
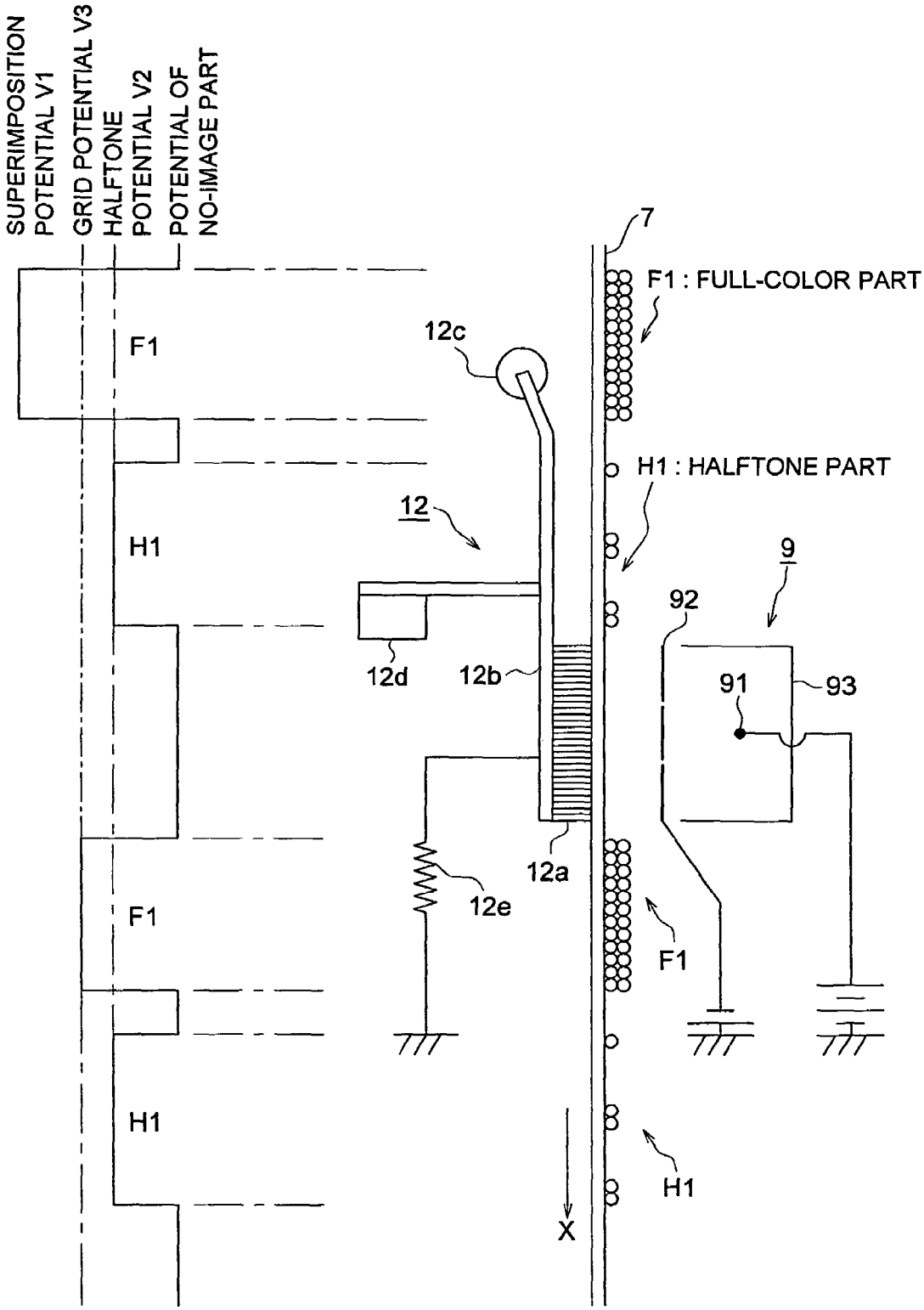
FIG. 5 is a sectional view showing outline structures of the scorotron discharger according to the second embodiment of the present invention and the opposite electrode, and a typical view showing the change of the toner layer potential before and after the passage of the scorotron discharger.

FIG. 5 is a sectional view showing the outline structure of the scorotron discharger 9 of FIG. 4. The same sign is affixed to the element of the same function as in FIG. 2, and the description is omitted.

In FIG. 5, on the rear side of the intermediate transfer body opposed to the scorotron discharger 9, the opposite electrode 12 composed of the electric conductive brush 12*a* as the elastic body electrode and the retaining member 12*b* for retaining the electric conductive brush 12*a*, is arranged, and the electric conductive brush 12*a* comes into contact with the rear side of the intermediate transfer belt by the pressing section which will be described later, further, the opposite electrode 12 is electrically grounded through the resistance 12*e*.

Further, FIG. 5 shows that, the weight is used in the third example as the pressing section for pressing the electric conductive brush 12*a*, which is the elastic body electrode of the opposite electrode 12, to the rear surface of the intermediate transfer body 7. And in FIG. 6, the state is shown by the perspective view.

Figure 6:
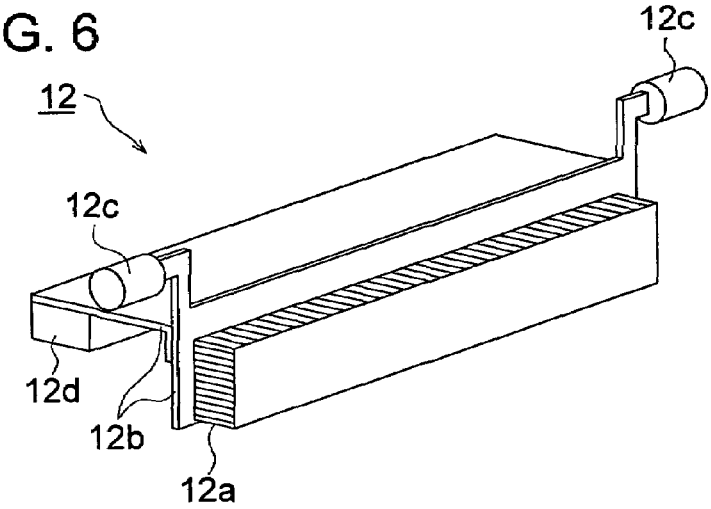
FIG. 6 is a perspective view of the embodiment using a weight as a pressing section of the opposite electrode.

In FIG. 6, the retaining member 12*b* for retaining the electric conductive brush 12*a* has a rotation fulcrum 12*c* at the both end parts, and it is structured that the rotation fulcrums 12*c* is made the rotation center and the electric conductive brush 12*a* presses the rear surface of the moving intermediate transfer body 7 by the torque load of the weight 12*d* provided on the retaining member 12*b*.

In the conventional color image forming apparatus, the opposite electrode is fixed, when brush material is used as the opposite electrode, it presses in the manner that the flexible brush hair is bent, further, when the sponge material is used as the opposite electrode, the sponge presses under the condition that the sponge is elastically deformed. However, when such a pressing section is used, it is fatigued by a long time use and the pressing force gradually decreases, the balance is also lost, and the discharge performance also deteriorates.

However, in the present embodiment, with such a structure, the pressing force is very stable, because the whole pressing force of the electric conductive brush 12*a* is determined by the torque weight of the weight 12*d*, however, it is preferable that the electric conductive brush 12*a* is made a elastic member whose rigidity of the side near the rotation fulcrum 12*c* is larger than the rigidity of the side far from the rotation fulcrum, because the difference is generated between a side near the rotation fulcrum 12*c* and the far side in the contact range of the electric conductive brush 12*a*. Herein, the difference of the rigidity is due to any one of the difference of brush density, difference of hair length, difference of hair diameter. Further, when the elastic body electrode is a sponge material, the difference of the rigidity is determined by the difference of hardness of foaming material.

A fitting position of the weight 12*d* to the retaining member 12*b* is determined by the position opposing to the belt-like intermediate transfer body 7 of the opposite electrode 12, and FIG. 5 shows the fitting position of the weight 12*d* which presses the intermediate transfer body 7 which is stretched in above and below direction and moved.

Figure 7:
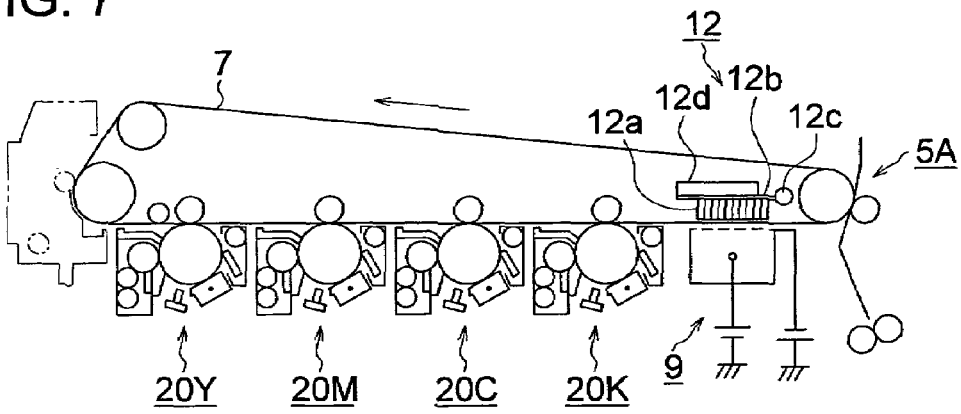
FIG. 7 is a sectional view showing another structure of the color image forming apparatus.

A color image forming apparatus shown in FIG. 7 is structured in such a manner that, to the intermediate transfer body 7 having the plane part in the left and right directions, and rotating in the arrowed direction, the image forming units 20Y, 20M, 20C, 20K, are arranged in parallel below the belt, and the toner image of 4 colors of Y, M, C, K is formed on the intermediate transfer body 7 in superimposition, and the discharge is conducted by the scorotron discharger 9 on the formed toner image, and after the discharge, the secondary image transfer is conducted.

Accordingly, because the opposite electrode 12 of the present embodiment is arranged so that it is brought into contact with the upper surface side of the belt from the upper side, the pressing force to the belt by the electric conductive brush 12*a* is determined by the self-weight of the electric conductive brush 12*a* section, and the weight 12*d* additionally provided to it.

Figure 8:
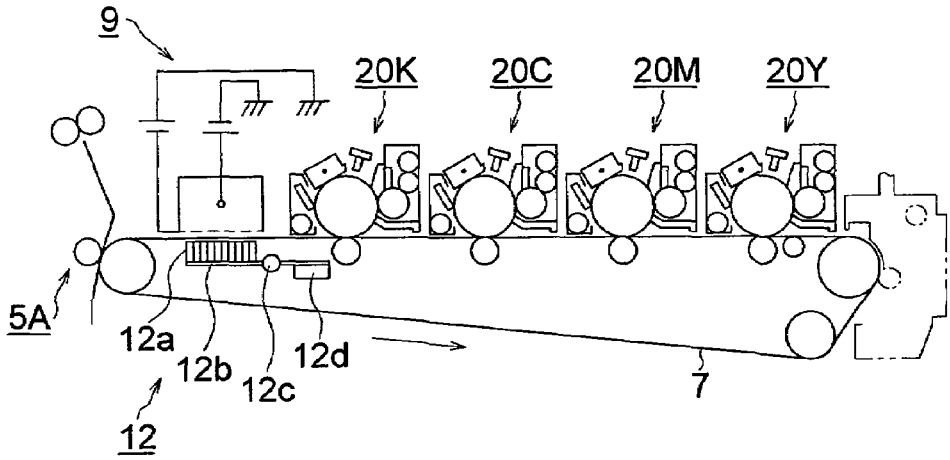
FIG. 8 is a sectional view showing other structure of the color image forming apparatus.

A color image forming apparatus shown in FIG. 8 is structured in such a manner that, to the intermediate transfer body 7 having the plane part in the left and right directions, and rotating in the arrowed direction, the image forming units 20Y, 20M, 20C, 20K, are arranged in parallel on the upper surface of the belt, and the toner image of 4 colors of Y, M, C, K is formed on the intermediate transfer body 7 in superimposition, and the discharge is conducted by the scorotron discharger 9 on the formed toner image, and after the discharge, the secondary image transfer is conducted.

Accordingly, it is structured in such a manner that, because the opposite electrode 12 of the present embodiment is arranged so that it is brought into contact with the lower surface side of the belt to the upper side from the upper side, when the weight 12*d* is provided on the opposite side to the electric conductive brush 12*a* of the retaining member 12*b* provided with the rotation fulcrum 12*c* between them, the pressing force to the belt of the electric conductive brush 12*a* is generated by the torque load of the weight 12*d*.

Figure 9:
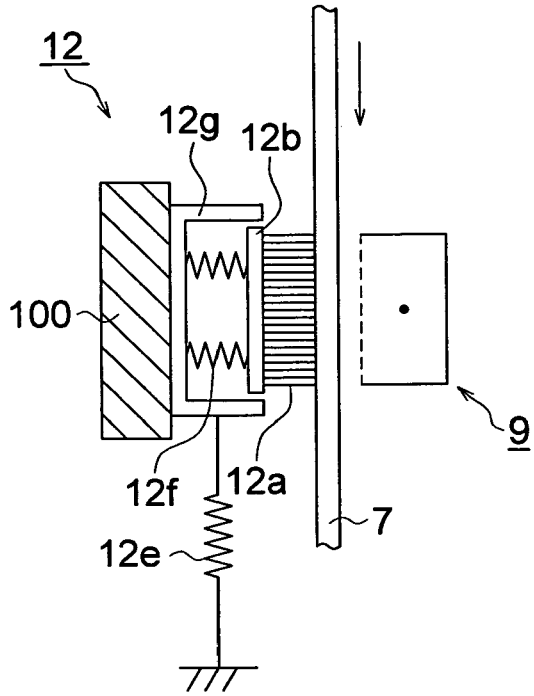
FIG. 9 is a sectional view of the embodiment using a spring member as the pressing section of the opposite electrode.

FIG. 9 is a sectional view showing the embodiment in which the spring material is used as the pressing section to the intermediate transfer body 7 of the electric conductive brush 12*a* which is an elastic body electrode.

In the present embodiment, it is arranged in such a manner that, from the back of the retaining member 12*b* on which the electric conductive brush 12*a* is fitted, by a plurality of compression springs 12*f*, the pressure to the intermediate transfer body 7 of the electric conductive brush 12*a* is uniform over the whole surface of the contact range, and a guide member 12*g* is a member by which the position regulation is conducted so that the electric conductive brush 12*a* which is in the pressed condition by the compression springs 12*f*, does not generate the movement or vibration, following the movement of the belt in the traveling direction, and is fixed to a main body fitting section 100. By such a structure, the stable discharging condition is maintained for a long period of time.

Figure 10:
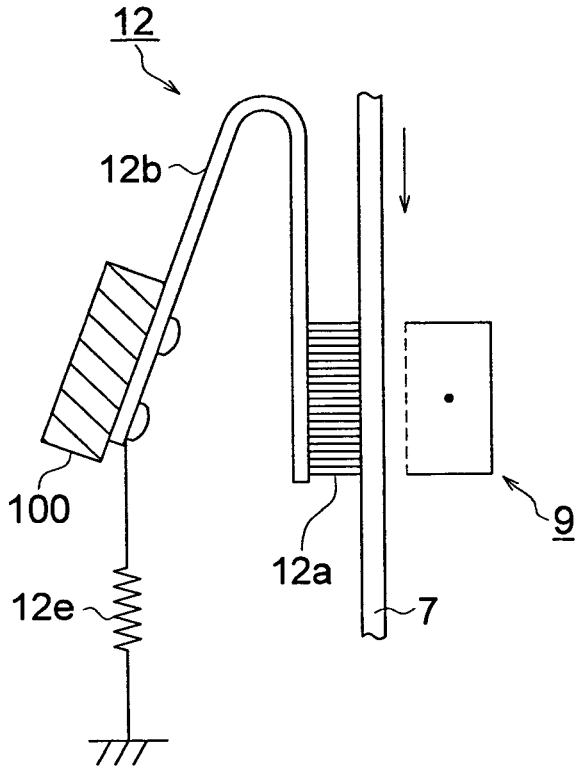
FIG. 10 is a sectional view of the embodiment using the spring force of the retaining member as the pressing section of the opposite electrode.

FIG. 10 is a sectional view showing an embodiment which presses by using the elasticity of the retaining member 12*b* for retaining the electric conductive brush 12*a* as the pressing section to the intermediate transfer body 7 of the electric conductive brush 12*a* which is an elastic body electrode.

As the retaining member 12*b*, for example, by using the metal thin sheet such as SUS material, as the shape in which the electric conductive brush 12*a* is fitted to one end of the metal thin sheet, bent and the elastic force is accumulated, the other end of the metal thin sheet is fitted to the main body fitting section 100, and the electric conductive brush 12*a* presses the moving intermediate transfer body 7 by the elastic force of the retaining member 12*b*. Hereupon, because there is a case where the vibration is generated following the movement of the belt, it may be also effectively conducted that clothes are adhered to the one surface of the retaining member 12*b* as the vibration absorption material. And when such a structure is applied, the stable discharge condition is maintained for a long period of time.

The present inventors conduct the following test for confirming the effect of the second embodiment.

As the third embodiment, a test is conducted under the condition that the electric conductive brush 12*a* described by using FIGS. 4-6, is brought into contact with the rear surface of the intermediate transfer body 7 by the load of 20 N/m by the weight 12*d*. And as the comparative example 3, it is structured in such a manner that the electric conductive brush 12*a* is fixed, and slides on the rear surface with a bent of penetration amount 1.5 mm of the brush hair, On the intermediate transfer body 7, a solid image in which a magenta image and a cyan image are superimposed is formed, and the potential after the discharge by the scorotron discharger is measured by the potential sensor 11 at the both end positions and the central position in the brush length direction with which the electric conductive brush 12*a* is brought into contact.

The test is conducted in such a manner that the potential measurement is conducted under two conditions at the time of setting as the new product condition at initial time of the setting, and at the time of 1 month after leaving the electric conductive brush 12*a* being in contact with the belt under the circumference of the temperature 10° C., RH 20% as a durability test.

The test result is shown in the following table.

TABLE 3

| | At new product condition | | | After left alone for 1 month | | |
|---|---|---|---|---|---|---|
| | Hither side position | Central part position | Farther side position | Hither side position | Central part position | Farther side position |
| Example 3 | −130 | −125 | −130 | −135 | −130 | −130 |
| Comparative example 3 | −135 | −125 | −130 | −145 | −140 | −145 |

(unit: V)

When at the time of the test, the toner layer potential before the discharge was about −170 V, and when the potential after the discharge was less than absolute value 140V, a good transfer image was obtained, however, for a position at which the potential after the discharge was −145 V, the generation of uneven transfer was observed. It became clear that, with the comparative example, a good transfer image was not obtained at the both ends of the brush after the durability test, while a good transfer image was obtained through the durability test with the third example.

Therefore, with the above mentioned embodiment, the elastic body electrode is used as the opposite electrode of the discharge section, and the elastic body electrode has the structure in which it is loaded to the intermediate transfer belt and uniformly pressed by the pressing section, a color image forming apparatus in which the pressing state is stable for a long period of time, a good discharge is maintained, and a good transfer image is obtained, is provided.

Furthermore, the electric conductive brush material is used as the elastic body electrode, the pressure on the contact part of the intermediate transfer belt is uniformly conducted over entire surface by the brush hairs, and good pressured state is maintained.

Furthermore, the electric conductive sponge material is used as the elastic body electrode, the pressure on the contact part of the intermediate transfer belt is uniformly conducted over entire surface by the elastically deformed sponge material, and good pressured state is maintained.

Furthermore, the weight is used as the pressing section, the elastic body electrode does not entirely vary the pressure force, and the pressure state on the intermediate transfer belt is maintained.

Furthermore, the pressing is conducted by using the pressing force of the spring member, the elastic body electrode is pressed for a long period of time from the back by the pressing force of the spring member, and the stable pressed state of the intermediate transfer belt is maintained.

Furthermore, the elastic body electrode is structured in such a manner that it is fixed by using adhesive agent, retaining member which retains the electrode is made a retaining member having the elasticity of for example the leaf spring, and the pressing of the intermediate transfer belt by the elastic body electrode is conducted by using the elasticity of the retaining member, by a simple structure, a stable pressed state on the intermediate transfer belt is maintained for a long period of time.

What is claimed is:

1. A color image forming apparatus, comprising:

an image carrier;

an image forming unit which forms a toner image on the image carrier;

a plurality of support members;

an intermediate transfer belt which is extended and given a tension by the plurality of support members;

a primary image transfer unit which transfers the toner image on the image carrier onto the intermediate transfer belt;

a secondary image transfer unit which transfers the toner image on the intermediate transfer belt onto a transfer material;

a scorotron discharger which is arranged on the upstream of the second image transfer unit, includes a discharge electrode and a grid electrode and discharges a charge on the toner image on the intermediate transfer belt; and an elastic body electrode which is arranged to be opposite to the scorotron discharger and to contact the back of the part of the intermediate transfer belt where the intermediate transfer belt is supported in a planar state;

wherein at least one of the plurality of support members has a configuration for adding more tension in the vicinity of the center of the intermediate transfer belt than in the vicinity of the both ends.

2. The color image forming apparatus of claim 1, wherein a bias voltage which causes a discharge of opposite polarity to a charge on the toner image is applied to the discharge electrode.

3. The color image forming apparatus of claim 1, wherein the supporting member having the configuration is a convex roller which has a bigger diameter at a central vicinity than at an end vicinity.

4. The color image forming apparatus of claim 1, wherein the supporting member having the configuration is arranged between a most downstream side's primary image transfer unit and the elastic body electrode.

5. The color image forming apparatus of claim 1, wherein the supporting member having the configuration is arranged between the elastic body electrode and the secondary image transfer unit.

6. The color image forming apparatus of claim 1, wherein the elastic body electrode includes electrically grounded conductive brush material.

7. The color image forming apparatus of claim 1, wherein the elastic body electrode includes electrically grounded conductive sponge material.

8. A color image forming apparatus, comprising:

an image carrier;

an image forming unit which forms a toner image on the image carrier;

a plurality of support members;

an intermediate transfer belt which is extended by the plurality of support members;

a primary image transfer unit which transfers the toner image on the image carrier onto the intermediate transfer belt;

a secondary image transfer unit which transfer the toner image on the intermediate transfer belt onto a transfer material;

a discharge section which is arranged on the upstream of the second transfer unit and discharges a charge on the toner image on the intermediate transfer belt; and an elastic body electrode which is arranged to be opposite to the discharge section and to contact the back of the intermediate transfer belt;

wherein the color image forming apparatus comprises a pressing section which presses the elastic body electrode to uniformly contact the intermediate transfer belt.

9. The color image forming apparatus of claim 8, wherein a bias voltage which causes an discharge of opposite polarity to a charge on the toner image is applied to the discharge electrode.

10. The color image forming apparatus of claim 8, wherein the elastic body electrode includes electrically grounded conductive brush material.

11. The color image forming apparatus of claim 8, wherein the elastic body electrode includes electrically grounded conductive sponge material.

12. The color image forming apparatus of claim 8, wherein the pressing section includes a weight, and a force of the heaviness of the weight presses the elastic body electrode.

13. The color image forming apparatus of claim 8, wherein the pressing section includes a spring member, and the spring member presses the elastic body electrode.

14. The color image forming apparatus of claim 8, wherein the pressing section includes a support member which has an elasticity and supports the elastic body electrode.

* * * * *